US006134730A

United States Patent [19]

Evanson

[11] Patent Number: 6,134,730

[45] Date of Patent: Oct. 24, 2000

[54] INTEGRATED BED COVERS WITH MATTRESS POCKET

[76] Inventor: Marika Evanson, 3448 Buchanan St. NE., Minneapolis, Minn. 55418-1405

[21] Appl. No.: 09/395,289

[22] Filed: Sep. 13, 1999

[51] Int. Cl.[7] ..... A47G 9/02

[52] U.S. Cl. ..... 5/482; 5/485; 5/498; 5/499; 5/500

[58] Field of Search ..... 5/482, 485, 494, 5/498, 499, 500, 502, 497

[56] References Cited

U.S. PATENT DOCUMENTS

| | | | |
|---|---|---|---|
| 2,695,414 | 11/1954 | Ford et al. | 5/485 |
| 3,654,646 | 4/1972 | McMahon | 5/485 |
| 3,824,640 | 7/1974 | Golden | 5/485 |
| 4,079,472 | 3/1978 | Maguire . | |
| 4,145,778 | 3/1979 | Ferrante et al. . | |
| 4,161,044 | 7/1979 | Bogle . | |
| 4,197,601 | 4/1980 | Maguire . | |
| 4,266,308 | 5/1981 | Schatz . | |
| 4,308,626 | 1/1982 | Weiss | 5/485 |
| 4,316,299 | 2/1982 | Friedman | 5/485 |
| 4,402,098 | 9/1983 | McClam . | |
| 4,413,368 | 11/1983 | Schuetze . | |
| 4,656,682 | 4/1987 | DeFelice et al. . | |
| 4,680,821 | 7/1987 | Maguire . | |
| 4,841,588 | 6/1989 | Harbin et al. | 5/494 |
| 4,964,184 | 10/1990 | Lewis . | |
| 5,084,929 | 2/1992 | Staudinger . | |
| 5,092,010 | 3/1992 | Wong . | |
| 5,099,531 | 3/1992 | Schmier | 5/494 |
| 5,884,349 | 3/1999 | Gretsinger | 5/494 |
| 5,901,389 | 5/1999 | Manner | 5/482 |

*Primary Examiner*—Terry Lee Melius
*Assistant Examiner*—Fredrick Conley
*Attorney, Agent, or Firm*—James V. Harmon

[57] ABSTRACT

Integrated bed covers for the mattress of a bed include an upper bed covering of one or more layer, for convenience referred to generically as a 'cover', e.g., a comforter or blanket, together with a mattress pocket adapted to fit around and enclose a lower portion of the mattress wherein the cover is expandably connected to the mattress pocket, that is to say, so that the bed cover (e.g., comforter or blanket) can be easily separated or expanded upwardly from the pocket and yet remained connected to it. I have found it possible to accomplish this objective by connecting to the pocket a base sheet or supporting sheet that extends laterally as well as beyond the end of the bed from the pocket and then securing the edges of this supporting sheet to the edges of the covering. This enables the cover to be reliably held in place on the bed by means of the mattress pocket and yet allows the cover to be raised upwardly away from the mattress pocket so as to provide an expandable opening for the feet between the cover and the mattress pocket so as to prevent the feet being confined or bound in place by the overlying cover. The cover can have three layers with laterally extending slits one each side near the foot of the bed. The slits are typically equal in length to that portion of the cover that hangs down alongside the side wall of the mattress.

18 Claims, 4 Drawing Sheets

INTEGRATED BED COVERS WITH MATTRESS POCKET

FIELD OF THE INVENTION

This invention relates to bedding and more particularly to bed covers or bed clothes.

BACKGROUND OF THE INVENTION

While a variety of bed coverings have been previously proposed that include a bedspread as a component, in most cases an inordinate amount of time is required to make the bed or move the bed coverings from the bed so they can be changed or washed. Because of the fast pace of modem life, many people find it inconvenient to have to separately and individually position all of the various coverings including sheet, blanket, comforter. The ability to make a bed quickly is not only important to the homemaker but is particularly important in commercial establishments such as hospitals and hotels. Making a bed can be especially difficult for disabled individuals. Moreover, current bedding makes it difficult for a person to get in and out of bed easily or to turn the covers back. In addition, current bedding tends to confine the feet so that they feel bound in place because of the downward pressure exerted by the upper sheet and blanket which are usually tightly folded under the lower surface of the mattress.

In view of these and other deficiencies of the prior art, it is one object of the present invention to provide a form of integrated bedding that facilitates making a bed and removing the bedding when the bedding is to be changed.

Another object is to provide bed clothing which stays securely on the bed but nevertheless allows a person to get in and out of the bed more easily than heretofore as well as providing adequate room for the feet so that they do not feel bound in place.

An additional object is to provide a form of bedding that can be easily turned back to the foot of the bed and yet will remain securely attached to the mattress until it is removed.

A further object is to provide a form of integrated bedding which is especially beneficial to hospital patients or disabled persons because it stays in place on the bed and yet will allow a person to get in and out of the bed more easily than conventional bedding.

Yet another object is to provide a form of bedding with the objectives and advantages already mentioned but which is also durable, rugged in construction, and can be mass produced.

These and other more detailed and specific objects of the present invention will be better understood by reference to the following figures and detailed description which illustrate by way of example of but a few of the various forms of the invention within the scope of the appended claims.

SUMMARY OF THE INVENTION

Briefly, the invention provides integrated bed covers for the mattress of a bed and includes an upper bed covering, for convenience referred to generically as a 'cover', e.g., a comforter or blanket with or without a sheet, together with a mattress pocket adapted to fit around and enclose a lower portion of the mattress wherein the cover layer is expandably connected to the mattress pocket, that is to say, so that the bed cover (e.g., comforter or blanket) can be easily separated or expanded upwardly from the pocket and yet remained connected to it. I have found it possible to accomplish this objective by connecting to the pocket a base sheet or supporting sheet that extends laterally as well as beyond the end of the bed from the pocket and securing the edges of this supporting sheet to the edges of the cover. This causes the cover to be reliably held in place on the bed by means of the mattress pocket and yet allows the cover to be raised upwardly away from the mattress pocket so as to provide an expandable opening for the feet between the cover and the mattress pocket so as to prevent the feet being confined or bound in place by the overlying cover. In a preferred form of the invention, the cover is provided on each side with laterally extending slits near the foot of the bed. The slits are typically equal in length to a portion of the cover that hangs down alongside the side wall of the mattress.

THE FIGURES

DETAILED DESCRIPTION OF THE INVENTION

Figure 1:
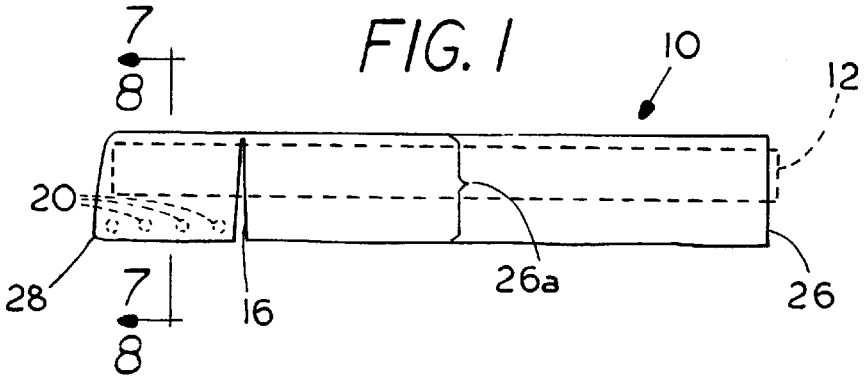
FIG. 1 is side elevational view of a bed using the present invention.
Figure 2:
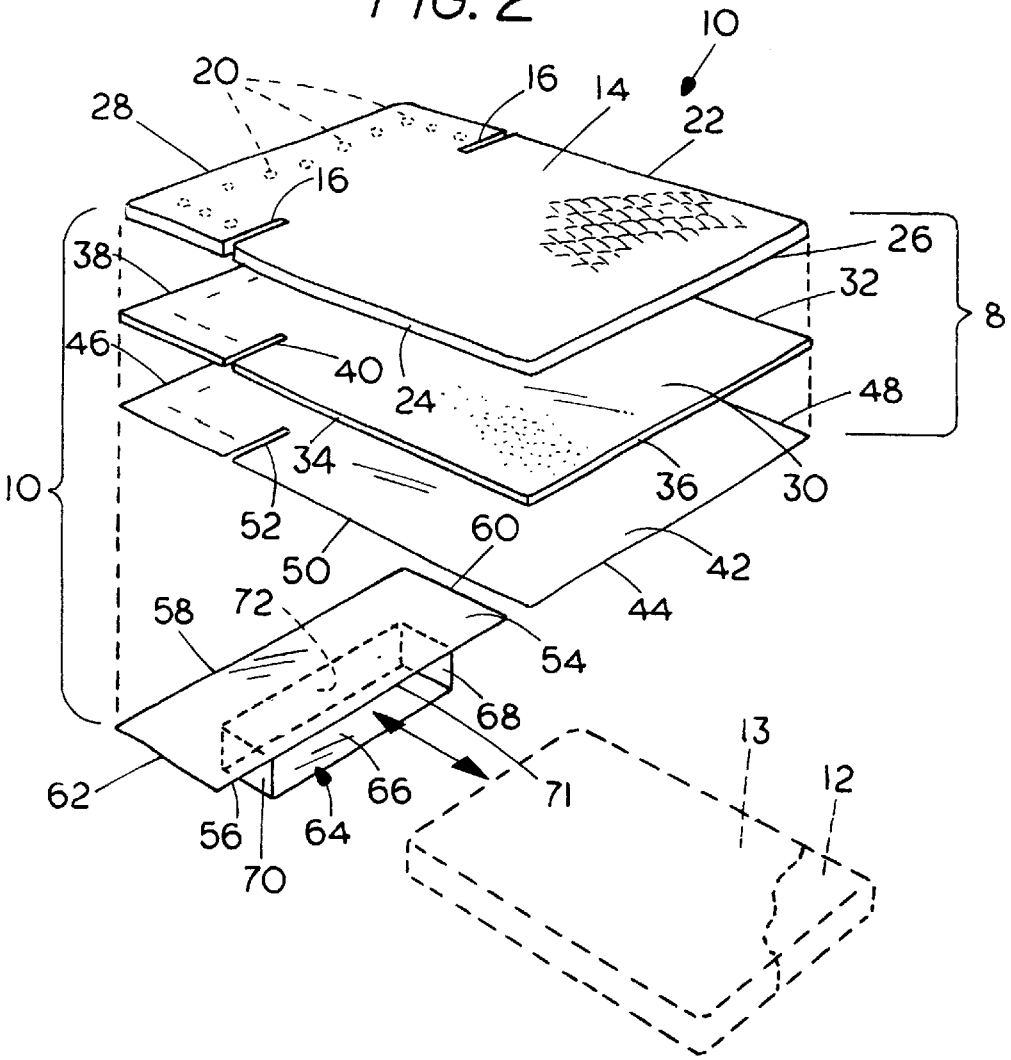
FIG. 2 is an exploded view of the invention as seen in perspective.

Refer now to the figures and particularly FIGS. 1 and 2 which illustrate an integrated bedding set in accordance with the invention, indicated generally at 10 and including a comforter 14 that is placed during use over a mattress 12 provided with a conventional fitted sheet 13 (FIG. 2) that forms no part of the invention. The integrated bedding 10 includes a cover 8 formed from one or more pieces of fabric, in this case three pieces comprising a comforter 14, a blanket 30, and a sheet 42. The blanket 30 and sheet 42 are generally used in any practical application of the present invention and are therefore highly preferred but are not utterly essential to the principle of the invention. The blanket 30 which is typically formed from cotton, wool, acetate, polyester or the like is provided to supply additional warmth, and the sheet 42 which is typically composed of cotton cloth, silk cloth or the like is used for comfort and because it can be readily washed. In certain atypical applications, e.g., use in the tropics or for certain military or hospital applications, one may desire to use only the comforter 14 and eliminate the blanket 30 and sheet 42. However, under most circumstances, the cover 8 consists of three layers which includes the comforter 14, the blanket 30 to supply additional warmth, and the sheet 42 to give the bedding a comfortable texture.

The comforter 14 can be of any suitable commercially available construction, typically including a filling comprising layers of cloth, polyester batting, feathers or down as desired. The comforter 14 includes top and bottom edges 26, 28, side edges 22, 24, and a pair of laterally extending aligned slits 16 near the bottom of the bed, e.g., about 30 inches from the bottom edge 28. The length of the slits 16 is about equal to the width of that portion 26*a* (FIG. 1) of the cover 8 which hangs down alongside the side wall of the mattress 12 so that the upper end of the slit 16 is generally aligned with the side edge of the mattress 12.

The blanket 30 includes side edges 32, 34 and upper and lower edges 36, 38. The blanket 30 when present is also provided with laterally extending slits 40 on each edge, only one of which is shown in FIG. 2. The blanket 30 is typically formed from cotton, wool, polyester, or acrylic and is provided to furnish additional warmth.

The sheet 42 includes upper and lower edges 44, 46, side edges 48, 50 and a pair of laterally extending aligned slits 52, only one of which is shown in FIG. 2. As can be seen in the figures, the slits 16, 40 and 52 are aligned one above another. This is also shown clearly in FIGS. 4 and 5.

The final and lower portion of the integrated bedding in accordance with the invention comprises a pocket 64 that comprises a sleeve which includes a bottom wall 66, side walls 68 and 70, and a top wall 71. While not utterly essential, it also preferably includes an end wall 72 so that when the pocket 64 is pulled onto the lower end of the mattress 12 so as to slide it over the bottom portion of the mattress 12 toward the head of the bed, it will stop when the lower end of the mattress strikes the end wall 72. Connected by sewing to the upper portion of the pocket 64 is a base or pocket support 54 comprising a rectangular piece of fabric having top and bottom edges 56, 58 and side edges 60, 62 which are spaced, i.e. extend laterally, beyond the side edges of the pocket 64. Likewise, the bottom edge 58 is spaced below the end wall 72 of the pocket 64, i.e., in a direction proceeding away from the head of the bed. The side and bottom edges of the pocket support 54 are connected to the corresponding diagonal edges of the comforter 14 by a sewn seam 65. The seam 65 has three segments, 65*a*, 65*b* and 65*c*. The pocket 64, as well as the integrated bedding set 10 itself, can be provided in different sizes to suit various size mattresses, e.g., twin, full, queen and king. If desired, the top wall 71 of the pocket 64 can be formed from a portion of the pocket support 54.

Figure 7:
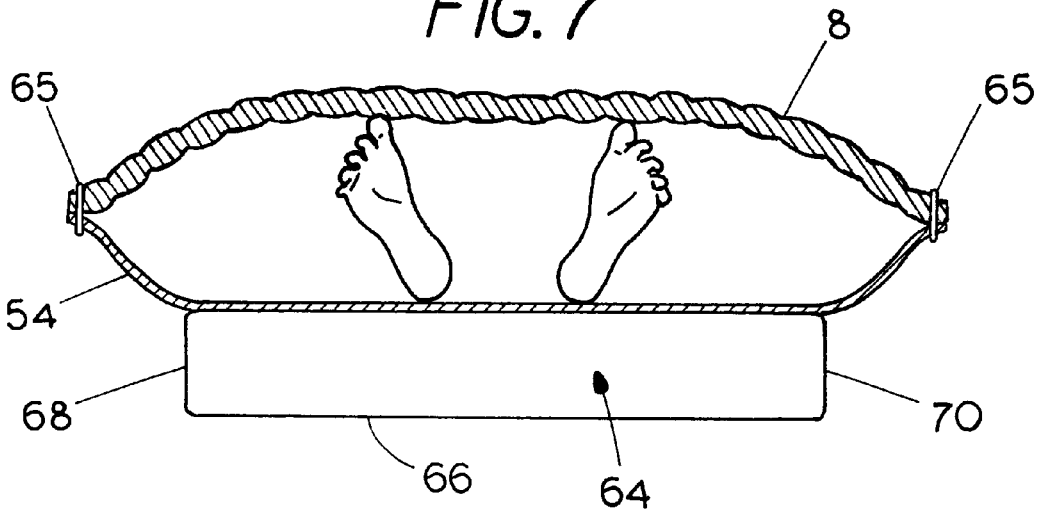
FIG. 7 is a vertical sectional view taken on line 7—7 of FIG. 1 showing a person in the bed with the comforter shown in a horizontal position.
Figure 8:
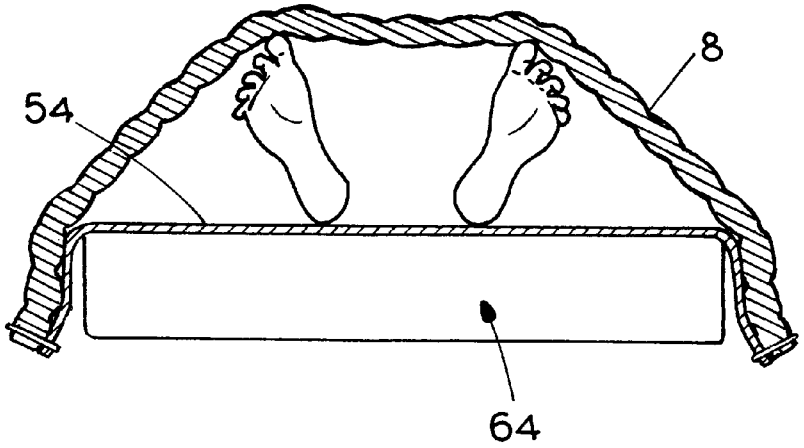
FIG. 8 is a vertical sectional view similar to FIG. 7 taken on line 8—8 of FIG. 1 showing the comforter in a draped position.

I have found that by providing a pocket support 54 with edges that extend laterally and toward the end of the bed beyond the pocket that I am able to secure the cover 8, including at least the upper cover layer 14 to the side and end edges of this support 54 so as to enable all layers of the cover 8 to be expandably secured to the pocket 64. This allows the cover 8 to be easily raised or separated from the pocket 64 to accommodate a person's feet and yet the cover 8 (or, if only one layer is used, the comforter 14) is reliably held in place and in the desired position on the mattress 12. During use, as shown in FIGS. 7 and 8, a person's feet are positioned between the pocket support 54 and the comforter 14 in the expandable space between them.

Figure 3:
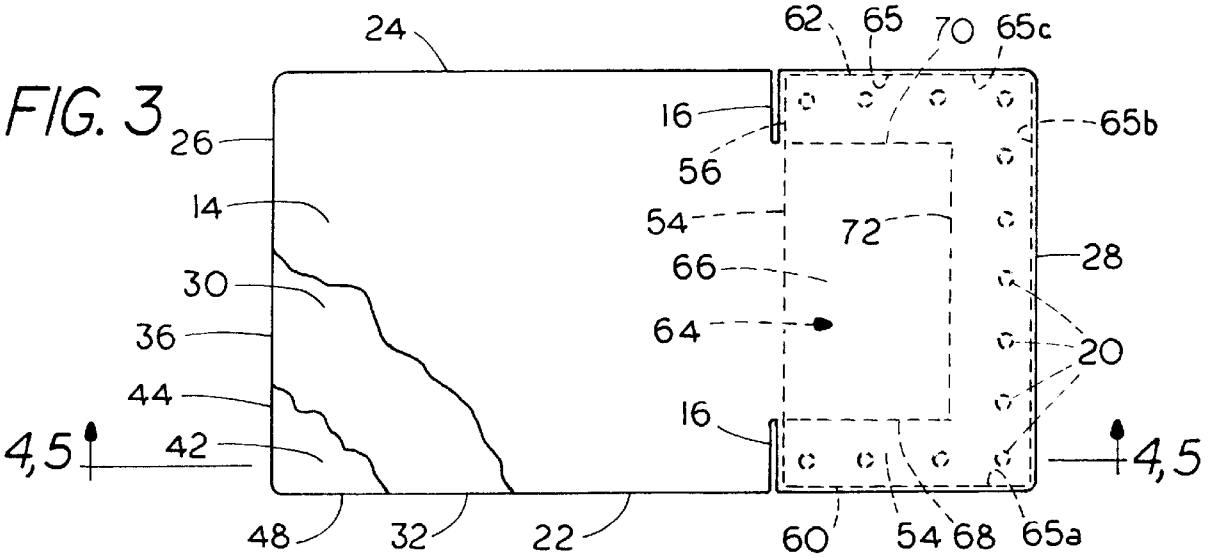
FIG. 3 is a plan view of the invention.
Figure 6:
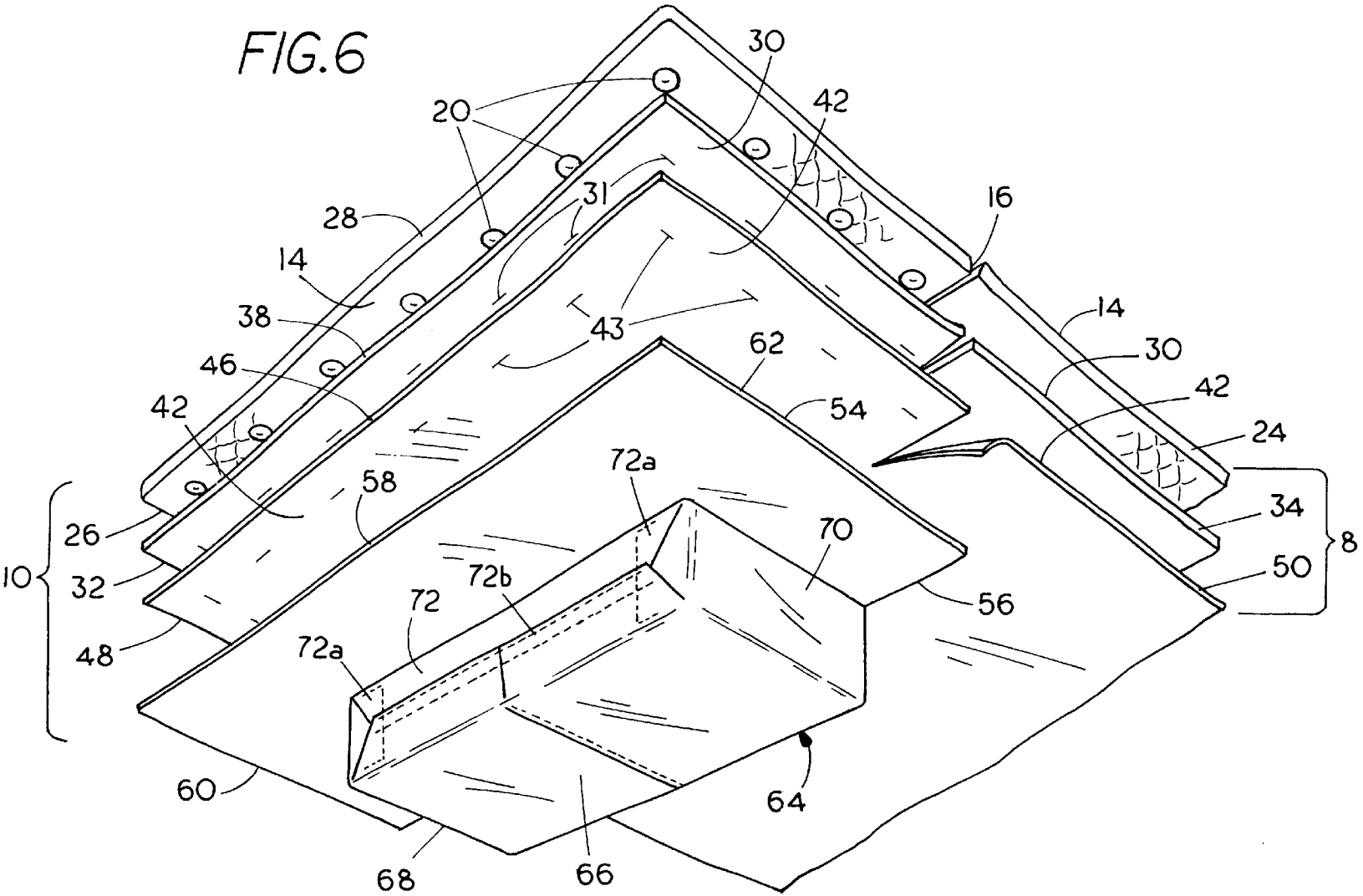
FIG. 6 is an exploded bottom perspective view of the invention.

The blanket 30 and the sheet 42 are secured to the comforter 14 at least at the bottom end of the integrated bedding by means of releasable fasteners, typically by means of buttons 20 which are sewn to the lower surface of the comforter 14 facing downwardly and extend through buttonholes 31 in the blanket 30 and 43 in the sheet 42 as seen in FIGS. 2 and 6. It will be seen in FIGS. 2 and 3 that some of the buttons 20 are positioned along the side edges of the comforter 14, blanket 30 and sheet 42, and some of the buttons 20 are placed along the end edges thereof. While buttons 20 are highly preferred, it is also possible to use other forms of fasteners such as zippers, snaps, hook-and-loop fastener strips, i.e., Velcro®, and the like for releasably fastening the blanket 30 and sheet 42 to the bottom portion of the comforter 14 along the side and end edges thereof.

As shown in FIG. 6, the end wall 72 of the pocket 64 can be reinforced by providing overlapping folds which are stitched together as shown as 72*a* and 72*b*.

Figure 4:
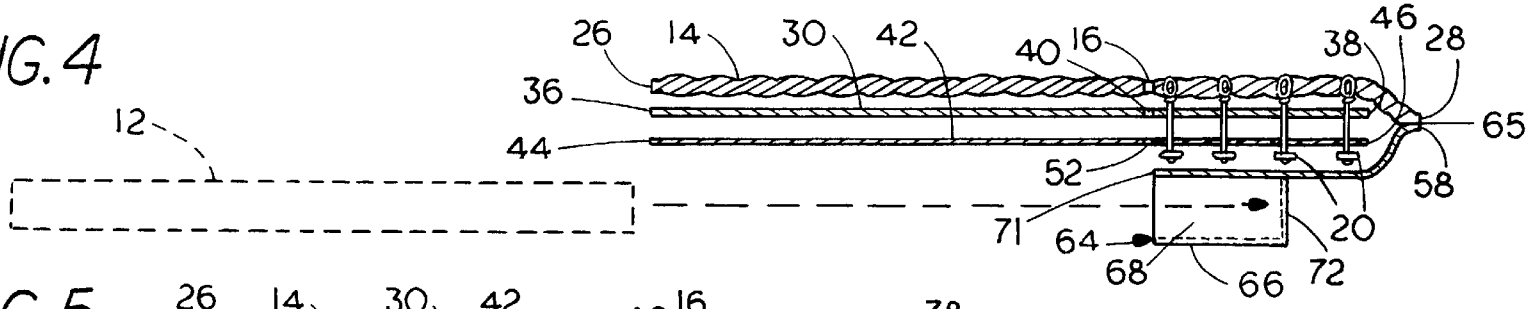
FIG. 4 is a diagrammatic side elevational view of the invention as shown in FIG. 3.
Figure 5:
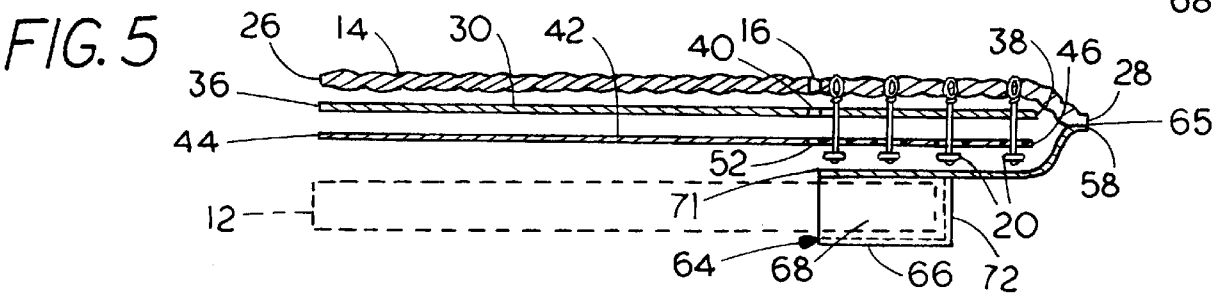
FIG. 5 is a view similar to FIG. 4 showing the mattress in place.

To use the integrated bed covers 10 in accordance with the present invention, the integrated cover set 10 is normally supplied in an assembled condition with the blanket 30 and sheet 42 buttoned to the inside of the lower portion of the comforter 14. The mattress 12 is first covered with an ordinary fitted sheet 13 which, if desired, can be supplied in the same bedding set with the invention. Next, the pocket 64 is pulled over the lower portion of the mattress 12 and fitted sheet 13 as shown in FIGS. 4 and 5. The bedding set 10 will then take the position shown in FIG. 5. When a person occupies the bed, the feet fit easily in the expandable space between the cover 8 (FIGS. 7 and 8) and the pocket support 54 while the pocket 64 remains secured to the mattress 12. While the bed is in use or before entering the bed, the cover 8 can be thrown back easily to the foot of the bed because of the separation between the top and bottom portions of the cover made possible by the slits 16, 40 and 52. This enables a person to get in and out of bed more easily than with conventional bedding, and yet the pocket 64 will reliably hold the entire integrated bedding set 10, including the comforter 14, blanket 30 and sheet 42 in place on the bed. Moreover, a person can, with a single motion, drawn the entire cover 8 upwardly toward the top of the bed and in that way make the bed in a single motion so as to provide exceptional time saving convenience for the person making the bed. The invention is therefore particularly beneficial for institutional use, e.g. in hospitals and hotels. Thus, the invention serves as a labor saving device as well as providing additional comfort for the user. When the bedding is to be washed, the blanket 30 and sheet 42 are preferably removed by undoing the buttons 20 and each part washed or cleaned separately as desired.

Many variations of the present invention within the scope of the appended claims will be apparent to those skilled in the art once the principles described herein are understood.

What is claimed is:

1. An integrated bed covering for a mattress of a bed, said integrated bed covering comprising, a) at least one sheet of fabric comprising a bed cover for being placed on top of a person occupying the bed, said bed cover having upper and lower laterally extending top and bottom edges and a pair of longitudinally extending laterally spaced apart side edges, b) a mattress pocket for placement below the person, said pocket having at least side, top and bottom portions that form a sleeve dimensioned to fit over a bottom portion of a mattress and having dimensions arranged to enable the pocket to fit around a bottom end portion of the mattress for holding the integrated bed covering in place on the mattress, c) a flexible pocket support member for placement below the person and being connected to the mattress pocket, and d) said pocket support member having lateral edge portions that extend laterally outwardly beyond the side edges of the mattress pocket, said lateral edge portions thereof are aligned with the side edges of the cover and are connected to the side edges of the cover such that the pocket support member is expandably connected to the bed cover for allowing expansion of a space for the feet of a person using the bed between the cover and the mattress pocket while the mattress pocket holds the integrated bed cover in place on the mattress of the bed during use.

2. The integrated bed covering of claim 1 wherein the bed cover and the pocket support member are secured together by a seam along said connected side edges of the cover and said bottom edge of the cover is secured by a seam to a corresponding bottom edge of the pocket support aligned therewith to provide said expandable space between the cover and the pocket support member to accommodate the feet of a person sleeping in the bed.

3. The integrated bed covering of claim 1 wherein the bed cover has a plurality of layers including a comforter, a blanket and a sheet, the comforter has an edge portion that is connected to the pocket, and the blanket and sheet are connected to the comforter by means of releasable fasteners.

4. The integrated bed covering of claim 3 wherein the releasable fasteners are buttons.

5. The integrated bed covering of claim 1 wherein the mattress pocket has an end wall on a lower end thereof adapted to be placed into contact with a lower end wall of said mattress when the pocket is slipped onto the lower end of the mattress.

6. The integrated bed covering of claim 1 wherein the pocket support comprises a sheet of material having a pair of longitudinally extending, laterally spaced apart parallel side edges that are positioned laterally beyond the side edges of the mattress pocket and a transversely extending lower edge which is spaced away from a lower edge of the pocket in a direction proceeding away from a top edge of the pocket, and the side and lower edge of the pocket support are connected to corresponding aligned side and bottom edges of the cover to thereby form an expandable space between the cover and the pocket support to accommodate the feet of a person sleeping in the bed without confirming the feet.

7. The integrated covering of claim 1 wherein the pocket support member has an edge at a foot end that a) is positioned outwardly beyond an end edge of the pocket so as to extend beyond a bottom edge of the mattress and b) is connected to the bottom edge of the cover, such that an expandable space for a person's feet extends beyond the sides of the bed and beyond the foot end of the bed to prevent the feet being bound in place by either the sides or bottom end of the overlying cover.

8. The integrated bed covering of claim 1 wherein the cover and the connected pocket support which have the space for the feet therebetween hang freely on each side of the mattress during use so that the space extends across the top of the mattress and downwardly on each side thereof.

9. The integrated bed covers of claim 1 wherein the cover includes a pair of centrally extending aligned slits in each of said side edges of the cover, and the slits are positioned adjacent a lower end of the cover so as to be located in proximity to a lower end of said mattress.

10. An integrated bed cover set for a mattress of a bed, comprising:

at least two superimposed bed covering layers for being placed on top of a person occupying the bed and having side edges and end edges and comprising upper and lower aligned layers, releasable connector means connecting selected edges of the cover layers to one another at least adjacent a bottom portion of said bed covers and the connector means being devoid of a connection to the mattress, a supporting layer formed from fabric and positioned below the lower bed covering layer for placement below the person and being connected to the upper bed covering layer along at least some of the edges thereof, the supporting layer has two side and one end edge that extend beyond side edges and a foot edge, respectively, of a mattress and are connected to aligned edges of one of the covering layers that also extend beyond the side and foot edges of the mattress, and a mattress holding means for placement below the person, said holding means is secured during use to the mattress and is connected to the supporting layer for holding the upper and lower covering layers in place on the mattress with an expandable space between the pocket supporting layer and the lower one of the bed covering layers, such that said space extends beyond the sides of the bed and beyond the foot end of the bed to accommodate the feet of a person sleeping in the bed without confining or binding the feet on either the sides or foot end thereof.

11. The integrated bed covers of claim 10 wherein the bed coverings include a third bed covering layer comprising a blanket aligned between the upper and lower covering layers, and the blanket is releasable connected to the integrated bed covers.

12. The integrated bed covering of claim 10 wherein the cover and the connected pocket support which have the space for the feet therebetween hang freely on each side of the mattress and on the foot end of the mattress during use such that the space extends across the top of the mattress and downwardly on each side and on the foot end thereof.

13. A bed covering for a mattress having a foot end and a head end, said bed covering comprising, a) at least one sheet of fabric comprising a bed cover for being placed on top of a person occupying the bed, said bed cover having upper and lower laterally extending top and bottom edges and a pair of longitudinally extending laterally spaced apart side edges, b) said side edges of the bed cover having a pair of laterally extending aligned slits spaced apart from said bottom edge of the cover and positioned closer to said bottom edge than said top edge thereof for being placed proximate to the foot end of the mattress but spaced apart from said foot end thereof, c) means attached to the cover and located below a person occupying the bed for holding the cover in place on the mattress, and d) said slits providing separation at the side edges of the cover between a top portion and a freely hanging bottom portion of the cover to facilitate the cover being thrown back by the user to the foot end of the mattress for enabling a person to get in or out of bed.

14. The bed cover of claim 13 wherein the bed cover has a plurality of superimposed cover layers and each of the cover layers has a pair of slits therein and the slits of each of the cover layers are in vertical alignment with one another.

15. The bed cover of claim 13 wherein the bed cover includes a side portion that during use hangs down over the side of the mattress and one end of each slit is aligned with a side edge of a top surface of the mattress when the cover is placed thereon.

16. The bed cover of claim 13 wherein the means for holding the cover in place on the bed comprises a piece of flexible material attached to the cover and adapted to engage the mattress for securing the cover to the mattress.

17. The bed cover of claim 13 wherein the means for holding the cover in place comprises a sleeve dimensioned to fit around a bottom portion of said mattress for securing the cover to the mattress.

18. The bed cover of claim 17 wherein the cover has a plurality of cover layers including a comforter, a blanket and a sheet, at least one of the layers is connected to the sleeve and means is provided for releasably connecting at least some of the edges of the cover layers to one another but not to the mattress for allowing the connected cover layers to be placed on the bed or removed from the bed simultaneously.

* * * * *

UNITED STATES PATENT AND TRADEMARK OFFICE

CERTIFICATE OF CORRECTION

PATENT NO. : 6,134,730

DATED : Oct. 24, 2000

INVENTOR(S) : EVANSON, Marika

It is certified that error appears in the above-indentified patent and that said Letters Patent is hereby corrected as shown below:

Col. 1, line 14, change "modem" to ---modern---.

Col. 5, line 34, change "confirming" to ---confining---.

Signed and Sealed this

Eighth Day of May, 2001

*Attest:*

Nicholas P. Godici

NICHOLAS P. GODICI

*Attesting Officer*

*Acting Director of the United States Patent and Trademark Office*